US007178914B2

(12) United States Patent
Marra, III et al.

(10) Patent No.: US 7,178,914 B2
(45) Date of Patent: Feb. 20, 2007

(54) MEDIA PRE-FEED IN INTERMITTENT PRINTER

(75) Inventors: Michael Anthony Marra, III, Lexington, KY (US); Randall David Mayo, Georgetown, KY (US); Barry Baxter Stout, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 100 days.

(21) Appl. No.: 10/792,499

(22) Filed: Mar. 3, 2004

(65) Prior Publication Data

US 2005/0195263 A1 Sep. 8, 2005

(51) Int. Cl.
*B41J 13/02* (2006.01)
*B65H 5/06* (2006.01)

(52) U.S. Cl. ..... 347/104; 400/630; 271/10.01; 271/10.03; 271/226

(58) Field of Classification Search .. 271/10.01–10.03, 271/226; 347/104; 400/630
See application file for complete search history.

(56) References Cited

U.S. PATENT DOCUMENTS

| | | | | |
|---|---|---|---|---|
| 3,517,921 A | | 6/1970 | Miciukiewicz | |
| 4,523,832 A | * | 6/1985 | Strutt et al. | 399/388 |
| 4,687,362 A | * | 8/1987 | Runzi | 400/630 |
| 4,728,966 A | * | 3/1988 | Piatt et al. | 346/134 |
| 4,737,804 A | | 4/1988 | Ayata et al. | |
| 5,056,771 A | * | 10/1991 | Beck et al. | 271/114 |
| 5,072,924 A | | 12/1991 | Sugiyama | |
| 5,223,858 A | * | 6/1993 | Yokoi et al. | 346/134 |
| 5,300,989 A | | 4/1994 | Shakib | |
| 5,390,016 A | | 2/1995 | Hoshi et al. | |
| 5,408,304 A | | 4/1995 | Serizawa | |
| 5,416,395 A | | 5/1995 | Hiramatsu et al. | |
| 6,533,264 B1 | * | 3/2003 | Tranquilla | 271/10.02 |
| 6,588,740 B2 | * | 7/2003 | Brugger et al. | 271/10.03 |
| 6,791,725 B1 | * | 9/2004 | Ohtani | 358/498 |

FOREIGN PATENT DOCUMENTS

| | | | |
|---|---|---|---|
| JP | 04004168 A | * | 1/1992 |
| JP | 08073062 A | * | 3/1996 |
| JP | 2000284556 A | * | 10/2000 |
| JP | 2002187634 A | * | 7/2002 |

* cited by examiner

*Primary Examiner*—Andrew H. Hirshfeld
*Assistant Examiner*—Jill E. Culler
(74) *Attorney, Agent, or Firm*—Taylor & Aust

(57) ABSTRACT

A printer (1) in which a first sheet (5) to be imaged by printhead (3) is followed by a trailing media sheet. The first sheet is stopped intermittently so that the printhead can traverse the first sheet to print a partial image. The trailing media sheet is stopped behind the first sheet and is moved intermittently until it reaches or is near nip rollers (9*a*, 9*b*). Exit rollers 11*a*, 11*b*, 11*c*, and 11*d* move the first sheet out of the printer. When the exit rollers and the nip roller move forward and backward together the first sheet may be exited before the nip rollers are reversed to align the second sheet. Alternatively, the first sheet may be moved backward during alignment. The intermittent movement of the sheets may be at different times and with the trailing sheet moved less times and longer amounts than the first sheet is moved.

15 Claims, 4 Drawing Sheets

MEDIA PRE-FEED IN INTERMITTENT PRINTER

TECHNICAL FIELD

This invention relates to imaging devices such as inkjet printers that advance paper intermittently during imaging. More specifically, this invention relates to pre-feeding media to increase printing speed.

BACKGROUND OF THE INVENTION

As inkjet printer have advanced in function and capability, it has become desirable to increase the amount of paper available in the printer. This can be achieved by a media tray located under the printer body. Such a location, however, separates the media in the tray from the printing mechanisms, resulting in an increased time to move the media from the tray to the printing mechanism.

Pre-feeding media (sometimes termed staging) is known to reduce the time for printing on each media. Such pre-feeding in the prior art is in one continuous movement to a second location. In an inkjet printer the prior media stops under the printhead while the printhead moves laterally over the media. The number of such stops depends on the active length of the printhead. This invention addresses pre-feeding in such a system.

DISCLOSURE OF THE INVENTION

In accordance with this invention, the trailing media is moved intermittently generally with the intermittent movement of the prior media being imaged. The trailing media need not be moved after each movement of the prior media as it may be desirable to move it longer amounts with each move. If the drive is by a single motor, such movement may be staggered with the prior sheet movement so as to minimize requirements of the drive motor. If nip rollers are employed with reverse motion to align the trailing media and if the drive system can not feed both forward and reverse simultaneously, the pre-feed may be terminated at the nip rollers so that the reverse action will occur after the exit for the imaged media.

The staging of printing may be implemented depending on the mode of printing. In a draft mode the prior media is moved in relatively large increments and staging the following sheet is more readily accomplished. Transparencies are difficult to feed and staging might not be employed.

BRIEF DESCRIPTION OF THE DRAWINGS

The details of this invention will be described in connection with the accompanying drawings, in which.

DESCRIPTION OF THE PREFERRED EMBODIMENTS

Figure 1:
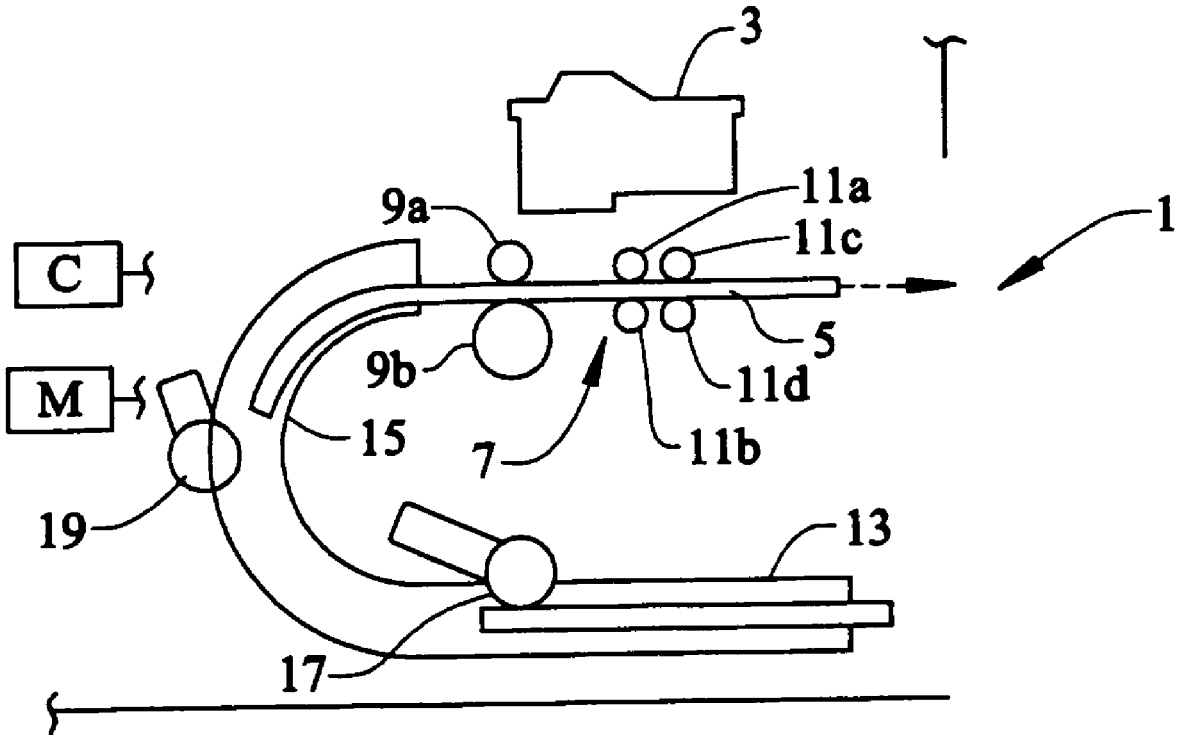
FIG. 1 illustrates a printer having a long, C-shaped path between a paper tray and the imaging printhead.

FIG. 1 is illustrative of a printer 1 with specific elements pertinent to this invention. Printer 1 may be a standard inkjet printer in most respects. As such it has a printhead bottle 3 which jets dots of ink through nozzles not shown, which are located above paper or other media sheet 5 at an imaging station 7.

Imaging station 7 is located past nip rollers 9*a*, 9*b* that grasp paper 5 in the nip of rollers 9*a*, 9*b* and move it under printhead 3. Nip rollers 9*a*, 9*b* are stopped normally several times to permit printhead 3 to partially image sheet 5 by moving across sheet 5 (in and out of the view of FIG. 1) while expelling dots in the desired pattern. In a draft mode the number of such intermittent stops may be only five, while in a quality mode that number may be many more than five. In a best-image mode the media may be advanced, for example, in one-eighth inch increments.

Nip rollers 9*a*, 9*b* push paper through the imaging station 7 where they enter exit rollers 11*a*, 11*b*, 11*c*, and 11*d*. Although rollers are by far the most common, simple mechanism to transport the imaged sheet 5 out of the printer 1 to the user of the printer 1, virtually any grasping device can be used, such as a belt and pressing device or pneumatic suction device.

The printer of FIG. 1 has a paper tray 13 located on the bottom. Tray 13 constitutes a bin in which a stack of paper or other media sheets 5 are held to be imaged. Having tray 13 located on the bottom of printer 1 permits a large stack of sheets 5 to be in the printer 1. This spaces the tray 13 from the imaging station 7 a significant distance, and delays in imaging arising from that spacing is what this invention minimizes.

A C-shaped paper guide 15 directs sheets 5 from the tray 13 to imaging station 7. Pick roller 17 at tray 13 and feed roller 19 combine to move sheet 5 from tray 13 to nip rollers 9*a*, 9*b*. As with the exit transport, although rollers such as 17 and 19 are widely preferred for their simple mechanism, virtually any grasping device, such as a belt pressing against the tray 13 and guide 15 or a pneumatic-suction device, can perform the function of removing a sheet 5 from tray 13 and moving that sheet as it is directed by guide 15 until it reaches nip rollers 9*a*, 9*b*.

Operational control is by electronic data processing apparatus, shown as element C in FIG. 1. Such control is now entirely standard. A standard microprocessor may be employed, although an application specific integrated circuit (commonly known as an ASIC) is also employed, which is essentially a special purpose computer. Such data processing apparatus controls all or virtually all of the actions and timing of printer 1. Electronic control is so efficient and versatile that mechanical control by cams and relays and the like are unknown in imaging. However, such control is not inconsistent with this invention.

Similarly, movement of parts in the printer is driven typically by one motor, shown illustratively as M.

This invention will now be described by operational flow with respect to three embodiments.

Near Nip, Exit First

To reduce complexity of a small printer, the exit transport often are rollers such as rollers 11*a*, 11*b*, 11*c*, and 11*d*, and are driven in direct connection with motor M. Similarly nip rollers, such as rollers 9*a*, 9*b* are driven in direct connection with motor M. Moreover, the media sheet 5 is aligned by moving it into the nip rollers when they are turning in reverse feed direction from normal imaging. This embodiment sacrifices some speed improvement by stopping the trailing sheet near, but somewhat before the nip. Imaging of the prior sheet is then completed, and the prior sheet may be still exiting before the next sheet reaches the nip to be aligned. After alignment the next sheet is then fed into the imaging station 7.

Figure 2:
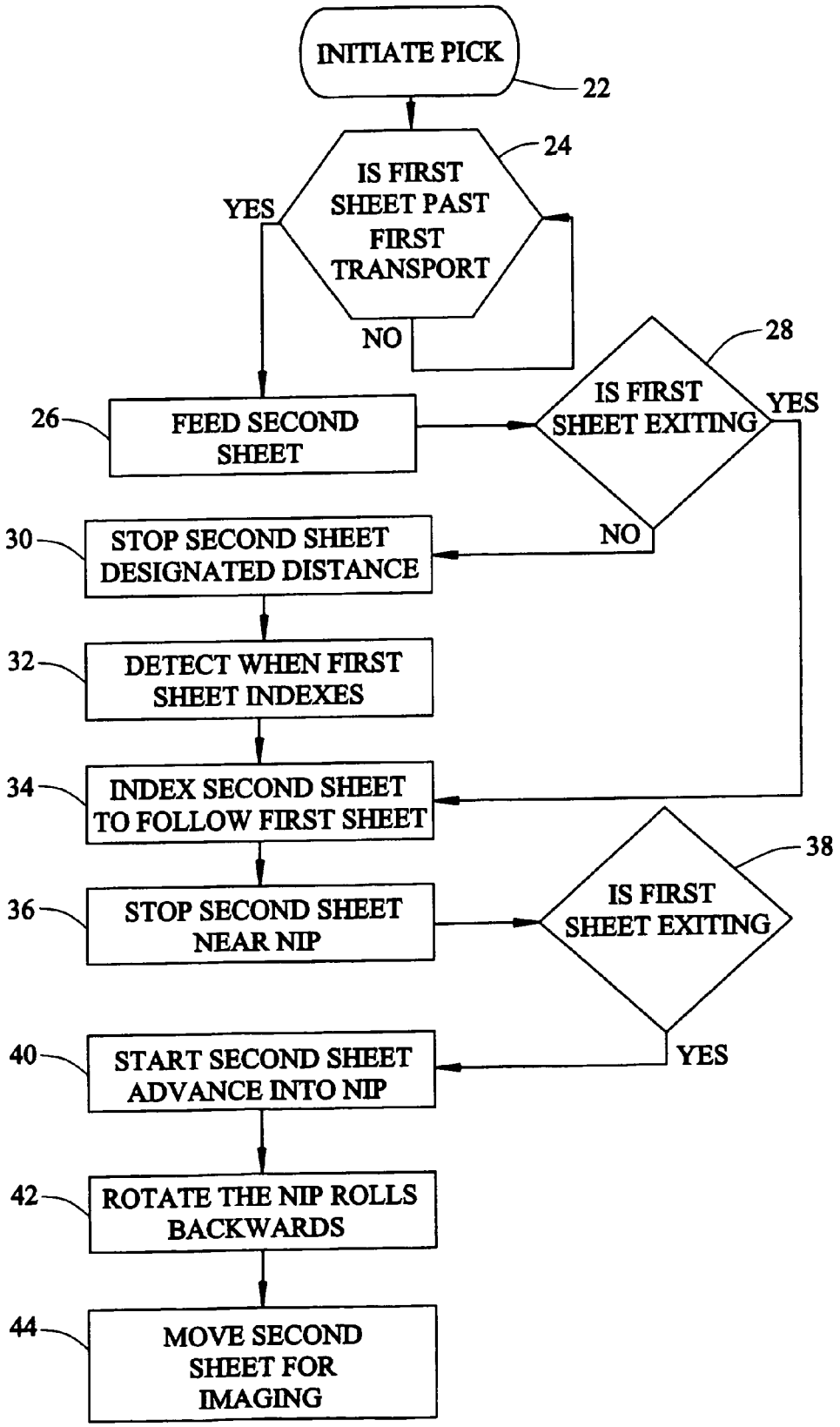
FIG. 2 is a sequence diagram illustrating one embodiment of this invention.

With reference to FIG. 2 the pick of a first sheet from tray 13 by pick roller 17 occurs during imaging in action 22. Decision 24 then determines if the first sheet is past feed roller 19. If no, this determination is made again after a short delay. If yes, in action 26 the second sheet is picked by pick roller 17 and fed by feed roller 19.

Decision 28 then determines if the first sheet is being exited. If no, action 30 stops the second sheet at a predetermined position. Then action 32 detects whether the first sheet is being moved. When that is detected, action 34 moves the second sheet the same amount. This movement need not be simultaneous since the first sheet will be stopped for imaging. This movement need not be in the same amount as the first sheet, as it can be less frequent but in longer amount than the movement of the first sheet.

In action 36 the second sheet is stopped near the nip of rollers 9*a* and 9*b*. Similarly, if decision 28 had found the first sheet being exited, action 34, move the second sheet, is directly conducted, followed by action 36.

Further sheet movement occurs when decision 38 finds the first sheet is being exited. Then in action 40 the second sheet is moved into the nip rollers 9*a*, 9*b*, and then nip rollers 9*a*, 9*b* are moved in reverse feed in action 42 to align (deskew) the second sheet. Then in action 44 the second sheet is moved for imaging. Accordingly, the terms "being exited" or "exiting" with respect to FIG. 2 refer to a status in which the first sheet will have exited before the motor M is reversed to reverse feed nip rollers 9*a*, 9*b*.

If the print job has a subsequent page to be printed, a subsequent sheet is fed as a new second sheet while the prior second sheet is imaged as the new first sheet.

In Nip, Exit First

Figure 3:
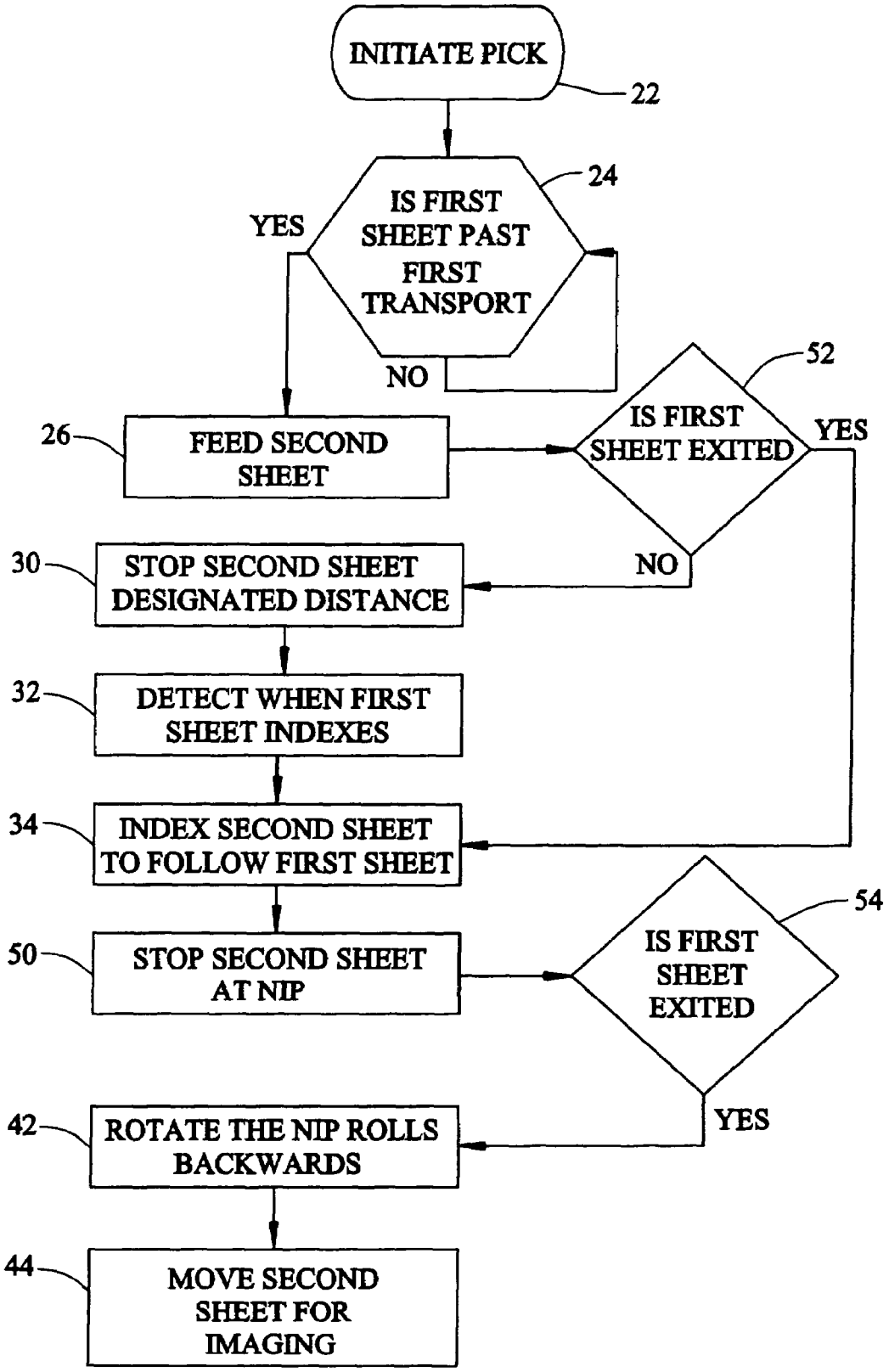
FIG. 3 is a sequence diagram illustrating a second embodiment of this invention.

This embodiment, to which FIG. 3 is directed, is similar to the foregoing embodiment except that it requires more precise timing and thereby saves some time. As in that embodiment, the motor is not reversed until a sheet is exited, as a sheet in the reversed exit rollers would be moved back toward the printing station.

This embodiment differs by action 34 activating action 50, which is to stop the sheet in the nip. This provides the maximum forward movement prior to reversing the nip rollers to align. The disadvantage is that the feed and measuring mechanism must be more exact and thereby subject to additional costs.

Since the next action after action 50 is to reverse motor M, this embodiment also differs by action 26 activating decision 52, which differs from decision 28 of the previous embodiment only in determining whether the first sheet has exited. Similarly, action 50 activates decision 54, which determines whether the first sheet has exited.

The remaining functions from action 50 of finding sheet exit in decision 54, which then reverses the feed rollers in action 42, and then moves the sheet for imaging in action 44 are the same as the previous embodiment, except for the first sheet being fully exited prior to action 42.

In Nip, Exit Last

Figure 4:
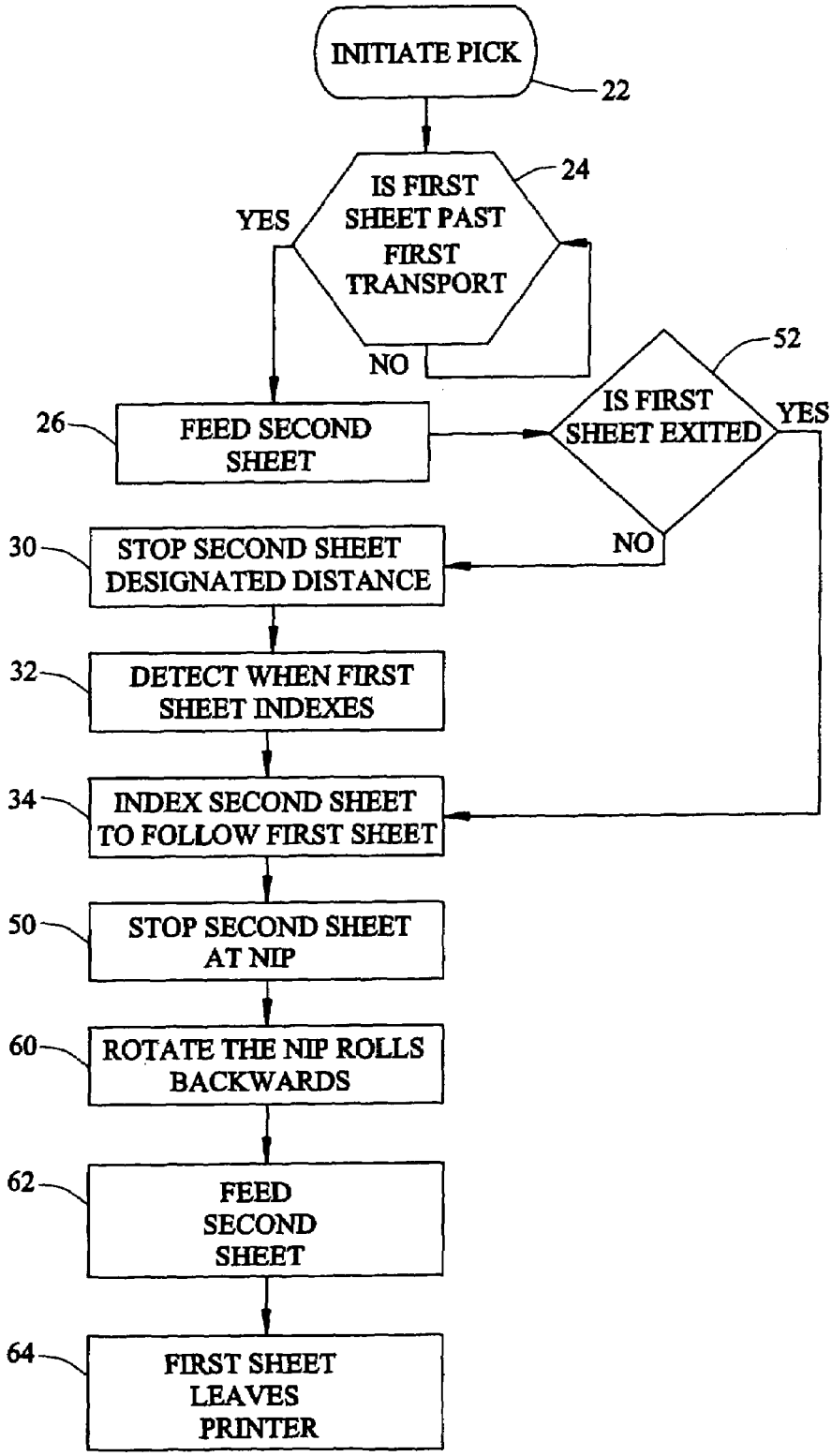
FIG. 4 is a sequence diagram illustrating a third embodiment of this invention.

This embodiment, to which FIG. 4 is directed, is the same as the immediately previous embodiment except that it exits the first sheet after alignment. Since the exit rollers turn with the motor, the first sheet is moved back somewhat toward the print station. This requires no backward obstruction and places some additional burden on the exit transport part and the motor.

This embodiment differs by action 50 activating action 60, which is the reversed feed regardless of exit of the first sheet. Accordingly, normally the first sheet is still in the exit transport and will be moved backward. Alignment typically requires only a small amount of rotation. Action 62 is then involved to feed the second sheet for imaging. In normal course the first sheet is exited in action 64.

Other Considerations

It is standard for printers as described to have sensors to locate the location of sheets in the feeding path. These sensors signal the controller C. Drive power from motor M to the first transport mechanism, rollers 17 and 19 may be by a simple clutch. Accordingly, additional structure required by this invention is typically, a clutch and possibly an additional sensor.

Where the exit transport can be terminated while the nip rollers are reversed for alignment, additional speed can be realized. This could be achieved by the exit transport being driven through a one-way clutch or by a second motor. Even in a system which waits for exit for the first sheet before movement of the second sheet, savings in printing time of more than 1.5 second per page printed can be realized.

With respect to all embodiments discussed, they may be implemented only in draft mode or other selected mode. Similarly, the second sheet may be moved at times different from times when the first sheet is moved; and the second sheet may be moved fewer times but longer distances than the first sheet.

The operation as described is conducted on all pages of a print job waiting in the printer. The fact of a following page may be known in various ways, as by the heading information in the data communicating the print job, from the interpreter forming the print job specifying the number of pages, from the sensing of a page waiting at the import port of the printer, and from an operator input.

What is claimed is:

1. A printer that prints by advancing a media sheet to an imaging station, stopping the printing sheet at the imaging station to effect partial imaging, and advancing the partially printed sheet in the imaging station to effect partial imaging, said printer comprising:

a bin to hold a stack of media sheets to be imaged, nip rollers proximate to said imaging station, a sheet guide to direct sheets from said bin to said nip rollers, at least one sheet transport roller located between said bin and said nip rollers to transport sheets from said bin to said nip rollers directed by said guide, an exit transport device to remove printed sheets from said imaging station, and operation control means to cause a first media sheet to be moved from said bin by said sheet transport roller directed by said guide to said nip rollers and, when said first sheet leaves said sheet transport roller, to cause a second sheet to be moved from said bin and to be stopped at said sheet transport roller behind said first sheet and to subsequently cause said first sheet and said second sheet to both move intermittently with said imaging, wherein said nip rollers are separate from said sheet transport roller and operate to move said first sheet intermittently for imaging at said imaging station, and wherein said sheet transport roller is spaced from said bin and spaced from said nip, and operates to move said second sheet intermittently.

2. The printer as in claim 1 in which said operational control means terminates said intermittent movement of said second sheet when said second sheet is proximate said nip rollers.

3. The printer as in claim 2 in which said exit transport device and said nip rollers both move in a forward sheet feed direction together and in a reverse sheet feed direction together and said operational control means reverses said nip rollers to align sheets at said nip rollers only after said exit transfer device exits said first sheet.

4. The printer as in claim 3 in which said operational control means continues said operation as described in claim 3 for all sheets in a print job of multiple sheets.

5. The printer as in claim 2 in which said exit transport device and said nip rollers both move in a forward sheet feed direction together and in a reverse sheet feed direction together and said operational control means reverses said nip rollers to align sheets at said nip rollers a predetermined amount while said first sheet is in said exit transport device and is moved toward said imaging station.

6. The printer as in claim 5 in which said operational control means continues said operation as described in claim 5 for all sheets in a print job of multiple sheets.

7. The printer as in claim 2 in which said operational control means continues said operation as described in claim 2 for all sheets in a print job of multiple sheets.

8. The printer as in claim 1 in which said operational control means terminates said intermittent movement of said second sheet when said second sheet is at said nip rollers.

9. The printer as in claim 8 in which said exit transport device and said nip rollers both move in a forward sheet feed direction together and in a reverse sheet feed direction together and said operational control means reverses said nip rollers to align sheets at said nip rollers only after said exit transfer device exits said first sheet.

10. The printer as in claim 9 in which said operational control means continues said operation as described in claim 9 for all sheets in a print job of multiple sheets.

11. The printer as in claim 8 in which said operational control means continues said operation as described in claim 8 for all sheets in a print job of multiple sheets.

12. The printer as in claim 1 in which said operational control means continues said operation as described in claim 1 for all sheets in a print job of multiple sheets.

13. A printer that prints by advancing a media sheet to an imaging station, stopping the printing sheet at the imaging station to effect partial imaging, and advancing the partially printed sheet in the imaging station to effect partial imaging, said printer comprising:

a bin to hold a stack of media sheets to be imaged, nip rollers proximate to said imaging station, a sheet guide to direct sheets from said bin to said nip rollers, at least one sheet transport roller located between said bin and said nip rollers to transport sheets from said bin to said nip rollers directed by said guide, an exit transport device to remove printed sheets from said imaging station, and operation control means to cause a first media sheet to be moved from said bin by said sheet transport roller directed by said guide to said nip rollers and, when said first sheet leaves said sheet transport roller, to cause a second sheet to be moved from said bin and to be stopped at said sheet transport roller behind said first sheet and to subsequently cause said first sheet and said second sheet to both move at different times with said imaging, wherein said nip rollers are separate from said sheet transport roller and operate to move said first sheet intermittently for imaging at said imaging station, and wherein said sheet transport roller is spaced from said bin and spaced from said nip and operates to move said second sheet at different times from said movement with imaging of said first sheet.

14. A printer that prints by advancing a media sheet to an imaging station, stopping the printing sheet at the imaging station to effect partial imaging, and advancing the partially printed sheet in the imaging station to effect partial imaging, said printer comprising:

a bin to hold a stack of media sheets to be imaged, nip rollers proximate to said imaging stations, a sheet guide to direct sheets from said bin to said nip rollers, at least one sheet transport roller located between said bin and said nip rollers to transport sheets from said bin to said nip rollers directed by said guide, an exit transport device to remove printed sheets from said imaging station, and operation control means to cause a first media sheet to be moved from said bin by said sheet transport roller directed by said guide to said nip rollers and, when said first sheet leaves said sheet transport roller, to cause a second sheet from said bin and to be stopped behind said first sheet and to subsequently cause said first sheet and said second sheet to both move intermittently with said printing with said second sheet being moved fewer times and by longer amounts than the movement of said first sheet, wherein said nip rollers are separate from said sheet transport roller and operate to move said first sheet intermittently for imaging at said imaging station, and wherein said sheet transport roller is spaced from said bin and spaced from said nip and operates to move said second sheet said longer amounts.

15. The printer as in claim 14 in which said operational control means causes said first sheet and said second sheet to move at different times with said printing.

* * * * *